US006561904B2

(12) United States Patent
Locke et al.

(10) Patent No.: US 6,561,904 B2
(45) Date of Patent: May 13, 2003

(54) DECREASING OR INCREASING NUMBER OF MULTIPLIERS FOR A MULTI-SPIN SLOT GAME

(75) Inventors: David K. Locke, Chicago, IL (US); Marc Raneses, Elk Grove Village, IL (US)

(73) Assignee: WMS Gaming Inc., Waukegan, IL (US)

( * ) Notice: Subject to any disclaimer, the term of this patent is extended or adjusted under 35 U.S.C. 154(b) by 22 days.

(21) Appl. No.: 09/950,193

(22) Filed: Sep. 10, 2001

(65) Prior Publication Data

US 2003/0054872 A1 Mar. 20, 2003

(51) Int. Cl.[7] ..... A63F 9/24
(52) U.S. Cl. ..... 463/25; 463/20
(58) Field of Search ..... 463/16–22, 25–28, 463/40–42; 273/143 R

(56) References Cited

U.S. PATENT DOCUMENTS 5,848,932 A 12/1998 Adams ..... 463/20
5,902,184 A 5/1999 Bennett ..... 463/13

FOREIGN PATENT DOCUMENTS

WO WO 01/51143 A1 7/2001 ..... A63F/5/04

OTHER PUBLICATIONS

Brochure for "Golden Harvest", Aristocrat, New South Wales, Australia, 2 pages, 2000.
Brochure for "Golden Pyramids", Aristocrat, New South Wales, Australia, 2 pages, 2000.
Brochure for "Queen of the Nile", Aristocrat, New South Wales Australia, 2 pages, 1999.

Brochure for "X–Factor", WMS Gaming Inc., Chicago, Illinois, 2 pages, undated.

Brochure for "Winning Streak", WMS Gaming Inc., Chicago, Illinois, 2 pages, undated.

Brochure for "Top Cat", WMS Gaming Inc., Chicago, Illinois, 2 pages, undated.

NewsReel article, "Introducing the First Four Mk VI Games", p. 18, Sep. 2000, Aristocrat Technologies Australia Pty Limited.

*Primary Examiner*—Michael O'Neill

(57) ABSTRACT

A game of chance is conducted on a gaming machine controlled by a processor in response to a wager. A primary game outcome is randomly selected from a plurality of possible primary game outcomes. In response to the primary game outcome being a bonus triggering outcome, a plurality of secondary game outcomes are randomly selected and represented with respective successive free spins of a plurality of symbol-bearing reels. In each free spin the reels are rotated and stopped to place symbols on the reels in visual association with a symbol array. Payout multipliers are randomly selected for, and vary with, the respective secondary game outcomes. Payouts are awarded for the respective secondary game outcomes according to a pay table. Each payout is multiplied by the respective payout multiplier.

15 Claims, 7 Drawing Sheets

DECREASING OR INCREASING NUMBER OF MULTIPLIERS FOR A MULTI-SPIN SLOT GAME

FIELD OF THE INVENTION

The present invention relates generally to games of chance conducted on gaming machines and, more particularly, to a multiplier feature for a multi-spin slot game.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available because such machines attract frequent play and hence increase profitability to the operator. Accordingly, in the competitive gaming machine industry, there is a continuing need for gaming machine manufacturers to produce new types of games, or enhancements to existing games, which will attract frequent play by enhancing the entertainment value and excitement associated with the game.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome of the basic game. Because the bonus game concept offers tremendous advantages in player appeal and excitement relative to other known games, and because such games are attractive to both players and operators, there is a continuing need to develop new features and themes for bonus games to satisfy the demands of players and operators. Preferably, such new bonus game features and themes will maintain, or even further enhance, the level of player excitement offered by bonus games heretofore known in the art. The present invention is directed to satisfying these needs.

SUMMARY OF THE INVENTION

A game of chance is conducted on a gaming machine controlled by a processor in response to a wager. A primary game outcome is randomly selected from a plurality of possible primary game outcomes. In response to the primary game outcome being a bonus triggering outcome, a plurality of secondary game outcomes are randomly selected and represented with respective successive free spins of a plurality of symbol-bearing reels. In each free spin the reels are rotated and stopped to place symbols on the reels in visual association with a symbol array. Payout multipliers are randomly selected for, and vary with, the respective secondary game outcomes. Payouts are awarded for the respective secondary game outcomes according to a pay table. Each payout is multiplied by the respective payout multiplier.

BRIEF DESCRIPTION OF THE DRAWINGS

The foregoing and other advantages of the invention will become apparent upon reading the following detailed description and upon reference to the drawings in which.

Figure 1:
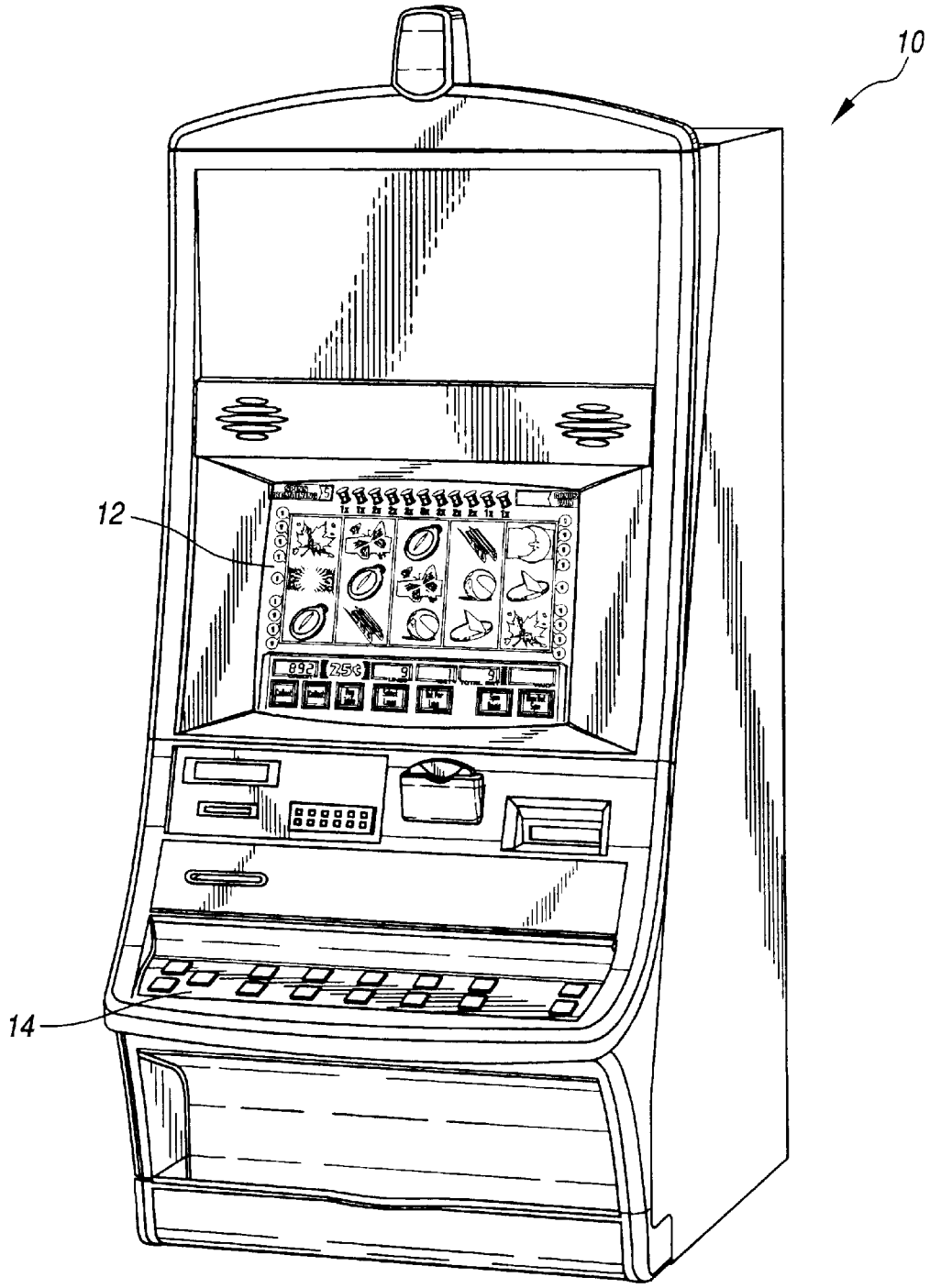
FIG. 1 is a perspective view of a gaming machine embodying the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Turning now to the drawings and referring initially to FIG. 1, a gaming machine 10 is operable to play a game of chance having a theme based on time and the seasons. The game of chance features a basic slot game with five simulated spinning reels and a multiple free spin feature triggered by a start-feature outcome in the basic slot game. In addition to the multiple free spin feature, the basic slot game may produce certain outcomes for triggering other special features and bonus games. The gaming machine 10 includes a visual display 12 preferably in the form of a dot matrix, CRT, LED, LCD, electro-luminescent, or other type of video display known in the art. The display 12 preferably includes a touch screen overlaying the monitor. In the illustrated embodiment, the gaming machine 10 is an "upright" version in which the display 12 is oriented vertically relative to the player. Alternatively, the gaming machine may be a "slant-top" version in which the display 12 is slanted at about a thirty-degree angle toward the player of the gaming machine 10.

Figure 2:
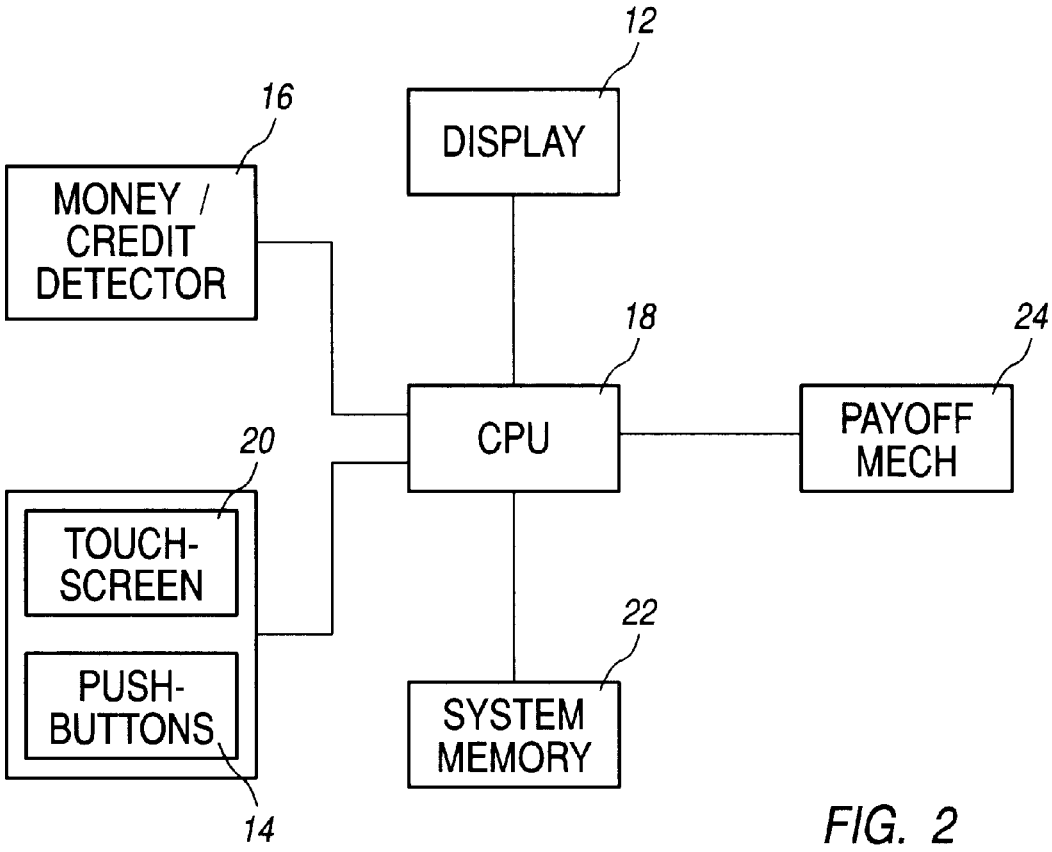
FIG. 2 is a block diagram of a control system suitable for operating the gaming machine.

FIG. 2 is a block diagram of a control system suitable for operating the gaming machine 10. Money/credit detector 16 signals a central processing unit ("CPU") 18 when a player has inserted money or played a number of credits. The money may be provided by coins, bills, tickets, coupons, cards, etc. Then, the CPU 18 operates to execute a game program that causes the display 12 to display five simulated symbol-bearing reels. The player may select a number of pay lines to play, an amount to wager, and start game play via the touch screen 20 or the push-buttons 14, causing the CPU 18 to set the reels in motion, randomly select a game outcome, and then stop the reels to display symbols corresponding to the pre-selected game outcome. In one embodiment, one of the basic game outcomes triggers a multiple free spin feature.

A system memory 22 stores control software, operational instructions and data associated with the gaming machine 10. In one embodiment, the system memory 22 comprises a separate read-only memory (ROM) and battery-backed random-access memory (RAM). However, it will be appreciated that the system memory 22 may be implemented on any of several alternative types of memory structures or may be implemented on a single memory structure. A payoff mechanism 24 is operable in response to instructions from the CPU 18 to award a payoff to the player in response to certain winning outcomes that might occur in the basic game or the multiple free spin feature. The payoff may be provided in the form of coins, bills, tickets, coupons, cards, etc. The payoff amounts are determined by one or more pay tables stored in the system memory 22.

Figure 3:
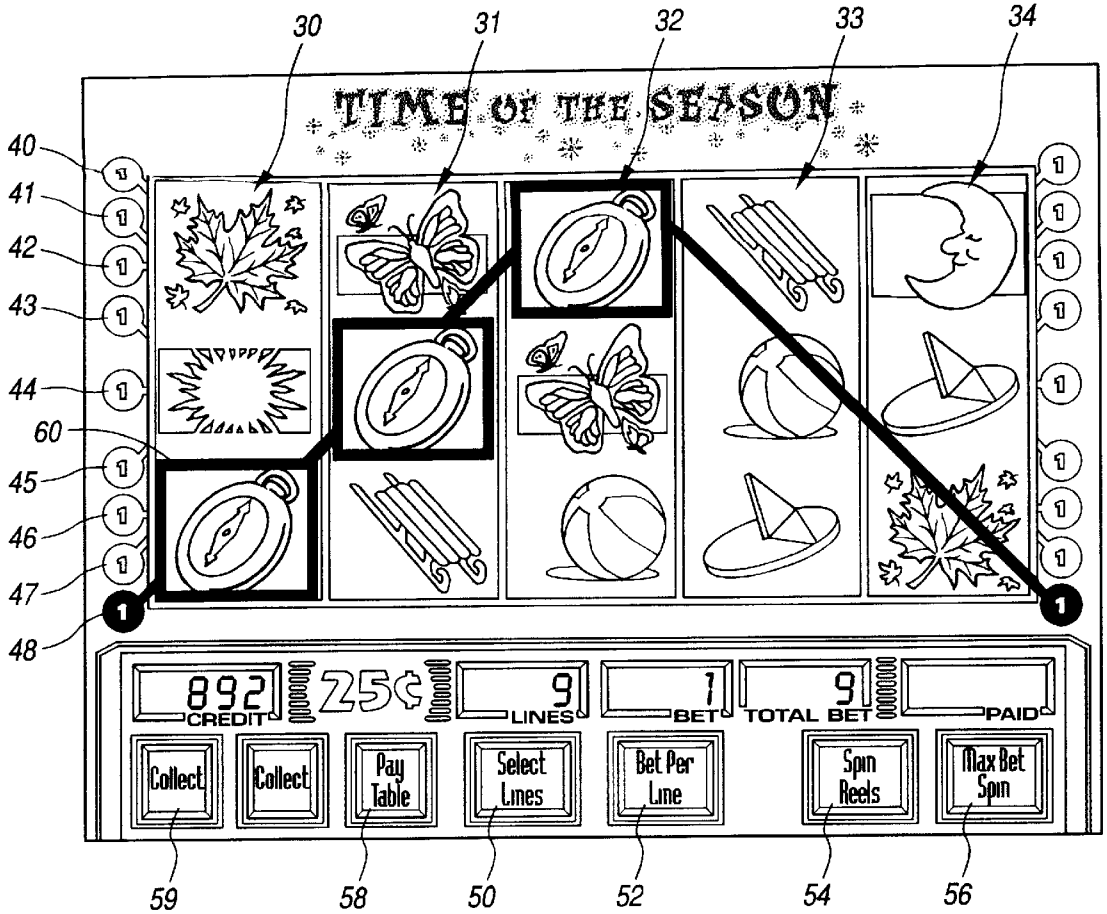
FIG. 3 is a display screen capture associated with a basic slot game and showing a symbol combination for triggering a multiple free spin feature.

Referring to FIG. 3, the basic game is implemented on the display 12 on five video simulated spinning reels 30–34 with nine pay lines 40–48. Each of the pay lines 40–48 extends through one symbol on each of the five reels 30–34. Generally, game play is initiated by inserting money or playing a number of credits, causing the CPU to activate a number of pay lines corresponding to the amount of money or number of credits played. In one embodiment, the player selects the number of pay lines (between one and nine) to play by pressing a "Select Lines" key 50 on the video display 12. The player then chooses the number of coins or credits to bet on the selected pay lines by pressing the "Bet Per Line" key 52.

After activation of the pay lines, the reels 30–34 may be set in motion by touching the "Spin Reels" key 54 or, if the player wishes to bet the maximum amount per line, by using the "Max Bet Spin" key 56 on the video display 12. Alternatively, other mechanisms such as, for example, a lever or push button may be used to set the reels in motion. The CPU uses a random number generator to select a game outcome (e.g., "basic" game outcome) corresponding to a particular set of reel "stop positions." The CPU then causes each of the video reels 30–34 to stop at the appropriate stop position. Video symbols are displayed on the reels 30–34 to graphically illustrate the reel stop positions and indicate whether the stop positions of the reels represent a winning game outcome.

Winning basic game outcomes (e.g., symbol combinations resulting in payment of coins or credits) are identifiable to the player by a pay table. In one embodiment, the pay table is affixed to the machine 10 and/or displayed by the video display 12 in response to a command by the player (e.g., by pressing the "Pay Table" button 58). A winning basic game outcome occurs when the symbols appearing on the reels 30–34 along an active pay line correspond to one of the winning combinations on the pay table. A winning combination, for example, could be three or more matching symbols along an active pay line, where the award is greater as the number of matching symbols along the active pay line increases. If the displayed symbols stop in a winning combination, the game credits the player an amount corresponding to the award in the pay table for that combination multiplied by the amount of credits bet on the winning pay line. The player may collect the amount of accumulated credits by pressing the "Collect" button 59. In one implementation, the winning combinations start from the first reel 30 (left to right) and span adjacent reels. In an alternative implementation, the winning combinations start from either the first reel 30 (left to right) or the fifth reel 34 (right to left) and span adjacent reels.

Included among the plurality of basic game outcomes is a start-feature outcome for triggering play of a multiple free spin feature. A start-feature outcome may be defined in any number of ways. For example, a start-feature outcome occurs when a special start-feature symbol or a special combination of symbols appears on one or more of the reels 30–34. The start-feature outcome may require the combination of symbols to appear along an active pay line, or may alternatively require that the combination of symbols appear anywhere on the display regardless of whether the symbols are along an active pay line. The appearance of the appropriate start-feature outcome causes the CPU to shift operation from the basic game to the multiple free spin feature of the present invention.

Figure 4:
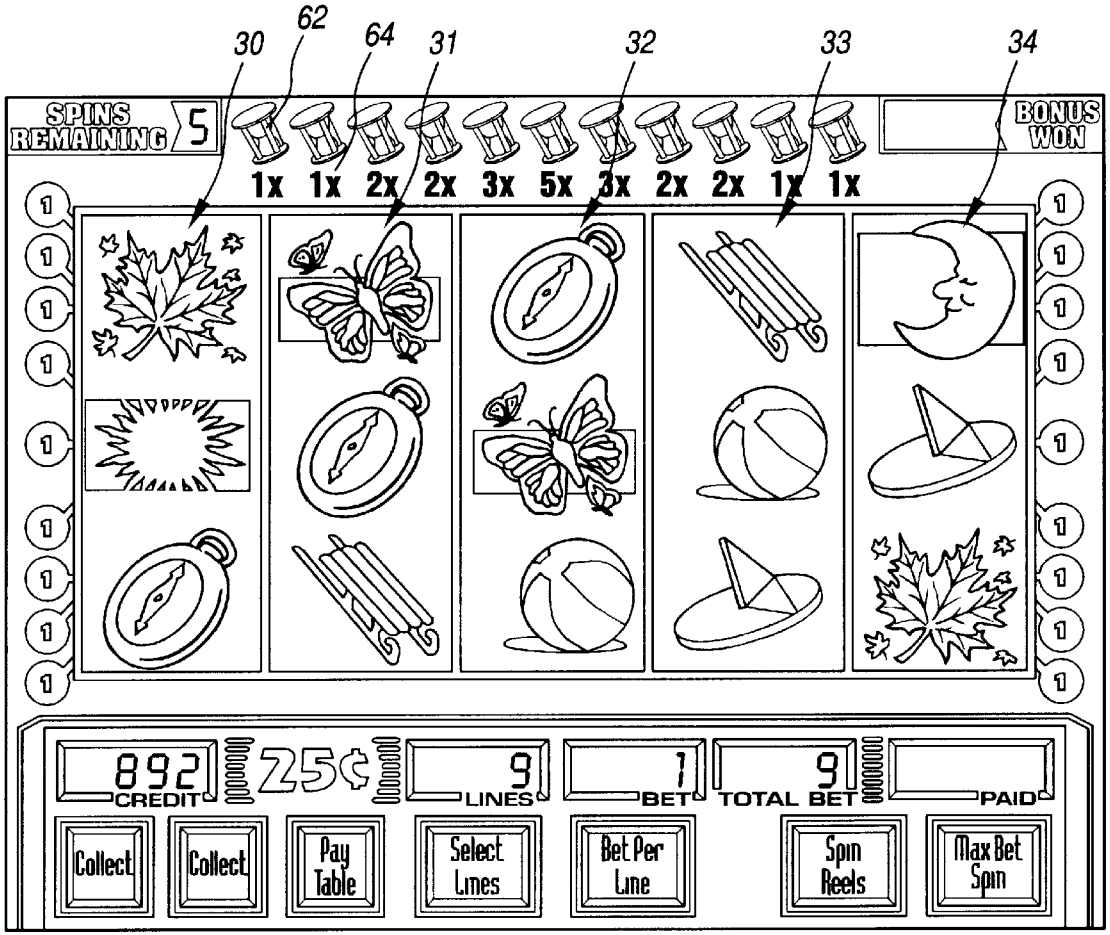
FIGS. 4, 5, 6, and 7 are display screen captures associated with the multiple free spin feature.

In the embodiment illustrated in FIG. 3, three CLOCK symbols 60 appearing anywhere in the reel display triggers the multiple free spin feature. In the multiple free spin feature, the player is awarded five free spins of the reels 30–34. Referring to FIG. 4, at the beginning of the free spin feature, the upper part of the display above the reels initially depicts a plurality of selectable hourglasses 62 and a plurality of payout multipliers 64 beneath the respective hourglasses 62. The multipliers 64 range from 1× to 5× and are depicted beneath the respective hourglasses 62 in the following symmetrical sequence: 1×, 1×, 2×, 2×, 3×, 5×, 3×, 2×, 2×, 1×, and 1×. The lowest multipliers of 1× are on the outside and gradually increase to the largest multiplier of 5× in the middle.

Prior to each free spin, the CPU randomly selects one of the hourglasses 62 and its associated multiplier 64 from the plurality of hourglasses 62. In one embodiment, the probability of selecting each hourglass 62 is the same, e.g., one in eleven. The probability of selecting each multiplier 64 is not the same, however, because the number of occurrences of each multiplier varies. For example, as shown in FIG. 4, the multipliers 1× and 2× each initially appear four times, the multiplier 3× initially appears two times, and the multiplier 5× initially appears one time. Therefore, the probability of selecting each multiplier prior to the first free spin is shown by the following table:

| Multiplier | Weight | Probability |
|---|---|---|
| 1x | 4 | 4/11 |
| 2x | 4 | 4/11 |
| 3x | 2 | 2/11 |
| 5x | 1 | 1/11 |

For each free spin of the reels 30–34, the CPU generally operates as it did in the basic slot game but, additionally, employs the selected multiplier 64 to multiply the payout awarded for any winning game outcomes. Specifically, the CPU randomly selects a game outcome and then rotates and stops the symbol-bearing reels to depict symbols representing the selected game outcome. If the selected game outcome corresponds to a winning outcome (e.g., symbol combinations resulting in payment of coins or credits), the player is awarded a payout according to the pay table for the basic slot game. This payout is then multiplied by the multiplier 64 associated with the hourglass 62 selected prior to the free spin.

Figure 5:
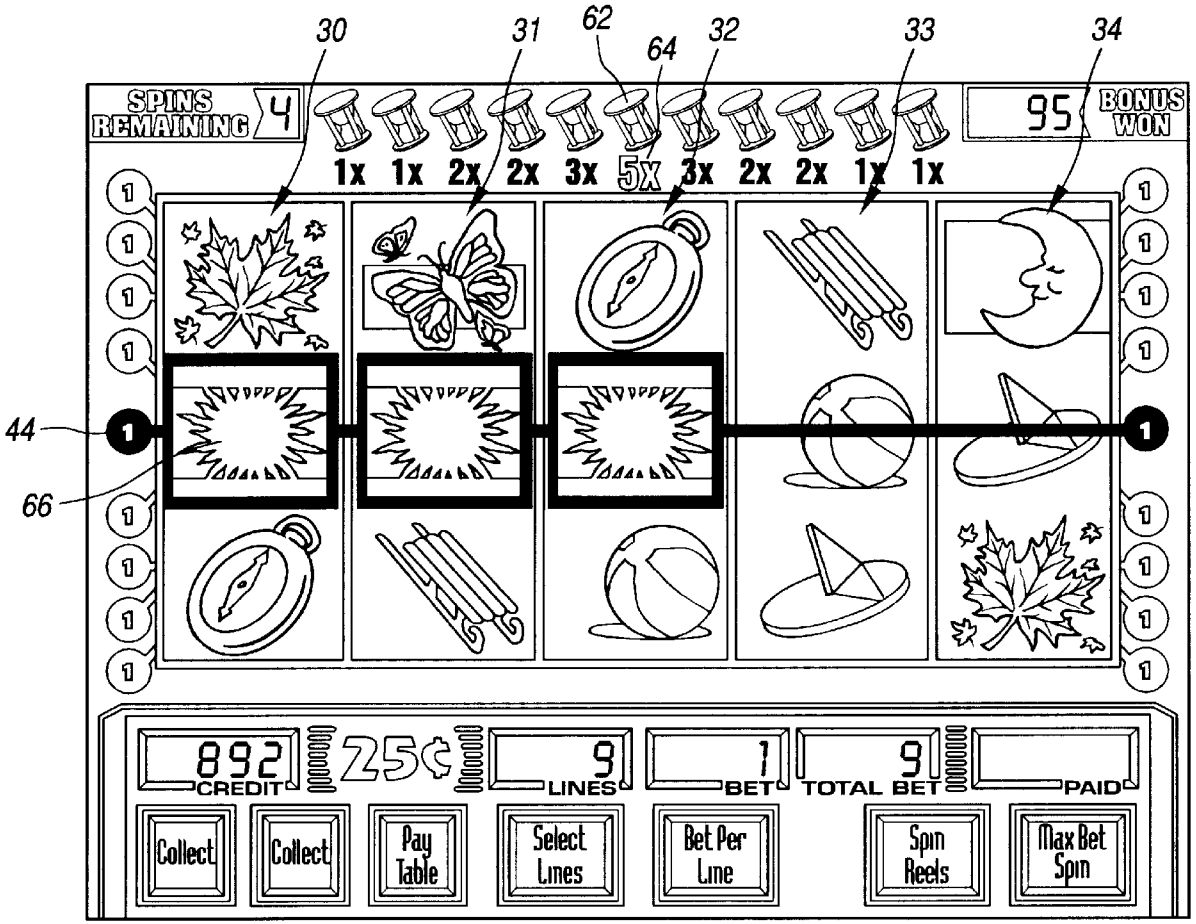

In the example illustrated in FIG. 4, prior to the first free spin, the CPU randomly selects the hourglass 62 associated with the multiplier 64 of 5×. As shown in FIG. 5, the first free spin results in a winning symbol combination of three SUN symbols 66 along pay line 44. According to the pay table, this winning symbol combination is normally associated with a payout of 19 credits. This payout is multiplied by the selected payout multiplier 64 of 5× to produce a total payout for the first free spin of 95 credits.

Figure 6:
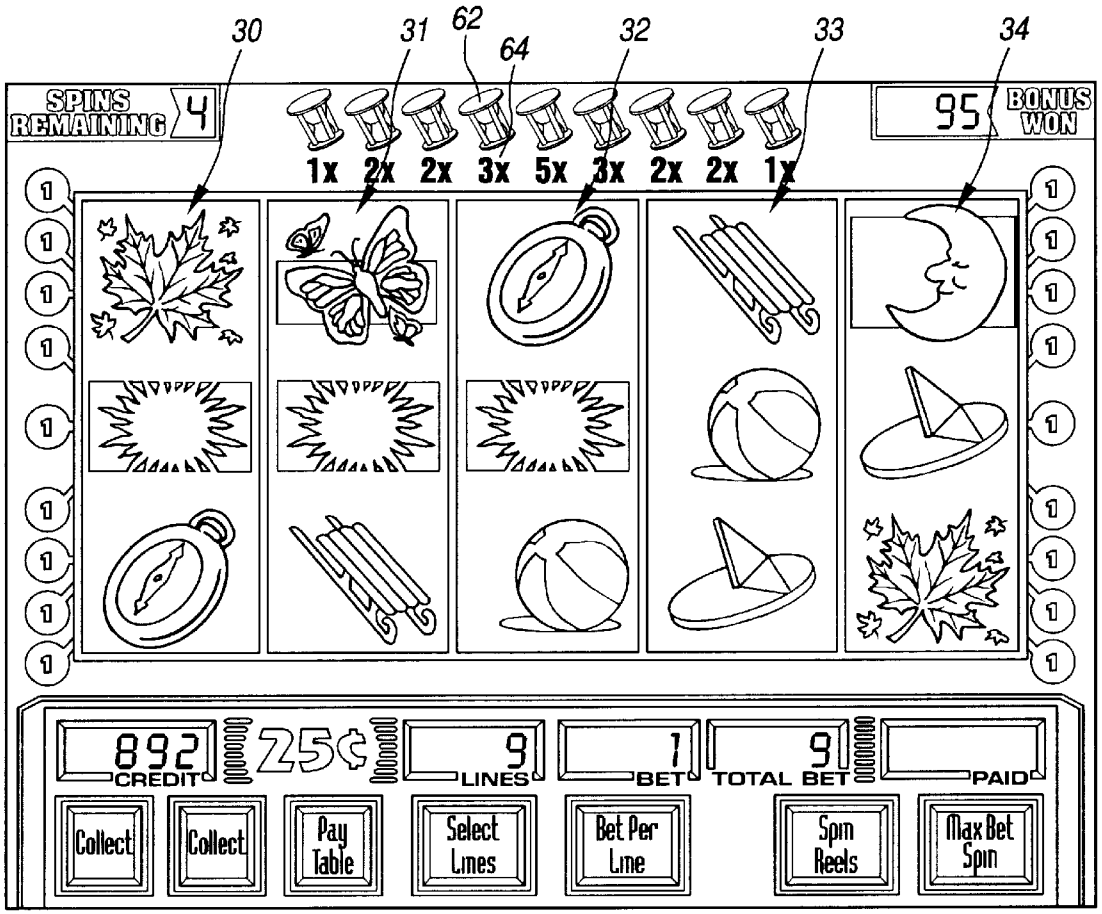

The above process is repeated for a total of five free spins. After each free spin, the CPU removes the outermost pair of hourglasses 62 and their associated multipliers 64 from the plurality of selectable hourglasses 62. Because the lowest multipliers 64 are associated with the outermost hourglasses 62, removing such hourglasses increases the probability of selecting an hourglass 62 associated with a higher payout multiplier 64. For example, referring to FIG. 6, after removing the outermost pair of hourglasses 62 and their associated multipliers 64 of 1× after the first free spin, the probability of selecting each multiplier prior to the second free spin is shown by the following table:

| Multiplier | Weight | Probability |
|---|---|---|
| 1x | 2 | 2/9 |
| 2x | 4 | 4/9 |
| 3x | 2 | 2/9 |
| 5x | 1 | 1/9 |

Similarly, after removing the remaining outermost pair of hourglasses 62 and their associated multipliers 64 of 1× after the second free spin, the probability of selecting each multiplier prior to the third free spin is shown by the following table:

| Multiplier | Weight | Probability |
|---|---|---|
| 1x | 0 | 0 |
| 2x | 4 | 4/7 |
| 3x | 2 | 2/7 |
| 5x | 1 | 1/7 |

It can be seen that the minimum multiplier 64 for the third free spin is 2×.

Similarly, after removing the remaining outermost pair of hourglasses 62 and their associated multipliers 64 of 2× after the third free spin, the probability of selecting each multiplier prior to the fourth free spin is shown by the following table:

| Multiplier | Weight | Probability |
|---|---|---|
| 1x | 0 | 0 |
| 2x | 2 | 2/5 |
| 3x | 2 | 2/5 |
| 5x | 1 | 1/5 |

Figure 7:
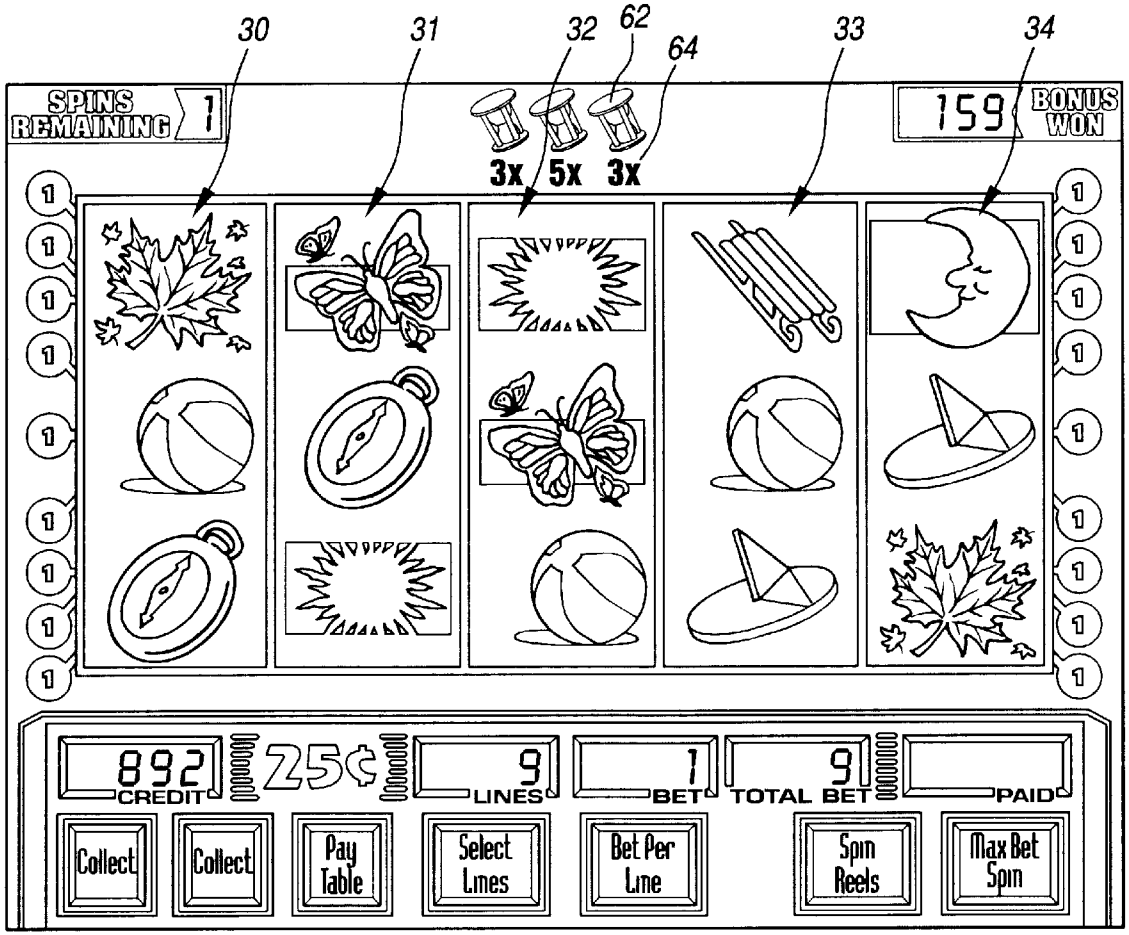

Finally, referring to FIG. 7, after removing the remaining outermost pair of hourglasses 62 and their associated multipliers 64 of 2× after the fourth free spin, the probability of selecting each multiplier prior to the fifth free spin is shown by the following table:

| Multiplier | Weight | Probability |
|---|---|---|
| 1x | 0 | 0 |
| 2x | 0 | 0 |
| 3x | 2 | 2/3 |
| 5x | 1 | 1/3 |

It can be seen that the minimum multiplier 64 for the fifth free spin is 3×. After the fifth free spin, the CPU shifts operation from the multiple free spin feature back to the basic slot game requiring another wager from the player.

While the present invention has been described with reference to one or more particular embodiments, those skilled in the art will recognize that many changes may be made thereto without departing from the spirit and scope of the present invention. For example, after each free spin in the free spin feature, payout multipliers need not be removed from the plurality of multipliers available for random selection. If, however, any payout multipliers are removed from the plurality of multipliers available for random selection, the multipliers may be removed based on some criteria other than removing the lowest pair of multipliers. For example, the multipliers may be removed randomly or starting with the highest pair instead of the lowest pair. Also, modifications may be made to such characteristics as the number of different multipliers, the number of occurrences (i.e., weight) of each multiplier, and the sequence in which the multipliers are depicted on the display. These characteristics may vary each time the free spin feature is triggered. Each of these embodiments and obvious variations thereof is contemplated as falling within the spirit and scope of the claimed invention, which is set forth in the following claims.

What is claimed is:

1. A method of conducting a game of chance on a gaming machine controlled by a processor, comprising:

receiving a wager from a player;

randomly selecting a plurality of outcomes;

representing the outcomes with respective successive selections of game indicia;

selecting a payout multiplier for each of the respective outcomes from a group of possible payout multipliers, the group of possible payout multipliers varying with the respective outcomes;

awarding payouts for the respective outcomes according to a pay table; and multiplying each payout by the respective selected payout multiplier.

2. The method of claim 1, wherein the step of representing the outcomes includes representing each of the outcomes with a plurality of symbols placed in a symbol array.

3. The method of claim 2, wherein the symbol array includes a plurality of rows and columns.

4. The method of claim 3, wherein the step of representing each of the outcomes with a plurality of symbols placed in a symbol array includes rotating and stopping a plurality of symbol-bearing reels to place the symbols on the reels in visual association with the symbol array.

5. The method of claim 1, wherein the step of selecting a payout multiplier for each of the respective outcomes from a group of possible payout multipliers includes randomly selecting each payout multiplier from the group of possible payout multipliers.

6. The method of claim 1, wherein the group of possible payout multipliers varies in number with the respective outcomes.

7. The method of claim 6, wherein the group of possible payout multipliers is successively reduced in number with the respective outcomes by successively removing smallest ones of the possible payout multipliers from the group of possible payout multipliers.

8. The method of claim 1, further including randomly selecting a primary game outcome, and wherein the step of randomly selecting a plurality of outcomes occurs in response to the primary game outcome being a bonus triggering outcome.

9. A method of conducting a game of chance on a gaming machine controlled by a processor, comprising:

receiving a wager from a player;

randomly selecting a primary game outcome from a plurality of possible primary game outcomes;

in response to the primary game outcome being a bonus triggering outcome, randomly selecting a plurality of secondary game outcomes;

representing the secondary game outcomes with respective successive free spins of a plurality of symbol-bearing reels, wherein in each free spin the reels are rotated and stopped to place symbols on the reels in visual association with a symbol array;

selecting a payout multiplier for each of the respective secondary game outcomes from a group of possible payout multipliers, the group of possible payout multipliers varying with the respective secondary game outcomes;

awarding payouts for the respective secondary game outcomes according to a pay table; and multiplying each payout by the respective selected payout multiplier.

10. The method of claim 9, wherein the step of selecting a payout multipliers for each of the respective secondary game outcomes from a group of possible payout multipliers includes randomly selecting each payout multiplier from the group of possible payout multipliers.

11. The method of claim 9, wherein the group of possible payout multipliers varies in number with the respective secondary game outcomes.

12. The method of claim 9, wherein the group of possible payout multipliers is successively reduced in number with the respective secondary game outcomes by successively removing smallest ones of the possible payout multipliers from the group of possible payout multipliers.

13. A method of conducting a game of chance on a gaming machine controlled by a processor, comprising:

receiving a wager from a player;

randomly selecting a plurality of outcomes;

representing the outcomes with respective successive spins of a plurality of symbol-bearing reels, wherein in each spin the reels are rotated and stopped to place symbols on the reels in visual association with a symbol array;

selecting a payout multiplier for each of the respective outcomes from a group of possible payout multipliers, the group of possible payout multipliers varying with the respective outcomes;

awarding payouts for the respective outcomes according to a pay table; and multiplying each payout by the respective selected payout multiplier.

14. A gaming machine controlled by a processor in response to a wager, comprising:

means for randomly selecting a plurality of outcomes;

means for representing the outcomes with respective successive selections of game indicia;

means for selecting a payout multiplier for each of the respective outcomes from a group of possible payout multipliers, the group of possible payout multipliers varying with the respective outcomes;

means for awarding payouts for the respective outcomes according to a pay table; and means for multiplying each payout by the respective selected payout multiplier.

15. A gaming machine controlled by a processor in response to a wager, comprising:

meals for randomly selecting a plurality of outcomes;

means for representing the outcomes with respective successive spins of a plurality of symbol-bearing reels, wherein in each spin the reels are rotated and stopped to place symbols on the reels in visual association with a symbol array;

means for selecting a payout multiplier for each of the respective outcomes from a group of possible payout multipliers, the group of possible payout multipliers varying with the respective outcomes;

means for awarding payouts for the respective outcomes according to a pay table; and means for multiplying each payout by the respective selected payout multiplier.

* * * * *